United States Patent [19]

Watkins et al.

[11] 4,093,116

[45] * June 6, 1978

[54] PANEL INTERLOCKING MEANS

[75] Inventors: Richard Kenneth Watkins, Lithonia; Leo Benatar, Atlanta, both of Ga.

[73] Assignee: The Mead Corporation, Dayton, Ohio

[ * ] Notice: The portion of the term of this patent subsequent to Mar. 7, 1995, has been disclaimed.

[21] Appl. No.: 759,116

[22] Filed: Jan. 13, 1977

[51] Int. Cl.[2] ..... B65D 75/08

[52] U.S. Cl. ..... 229/40; 229/48 R; 206/434; 206/147; 24/204

[58] Field of Search ..... 229/48 R, 40; 206/434, 206/147; 24/204

[56] References Cited

U.S. PATENT DOCUMENTS

| | | | |
|---|---|---|---|
| 3,248,004 | 4/1966 | Weiss | 229/40 |
| 3,367,557 | 2/1968 | Farquhar | 229/40 |
| 3,432,029 | 3/1969 | Brown | 229/40 |
| 3,570,746 | 3/1971 | Wood | 229/40 |
| 3,679,121 | 7/1972 | Morgese | 229/40 |

*Primary Examiner*—William Price
*Assistant Examiner*—Joseph M. Moy
*Attorney, Agent, or Firm*—Walter M. Rodgers; Walter A. Rodgers

[57] ABSTRACT

Panel interlocking means for securing a pair of panels in overlapping face contacting relation includes a locking tab struck from one of the panels and arranged to be driven through a locking aperture defined by a retaining tab struck from the other panel and arranged so that its free end engages the locking tab in angularly disposed mutually bracing relation, holding means formed in said locking tab for receiving the free end of said retaining tab to hold said locking tab and said retaining tab in angular braced relation to each other, a securing tab projecting from a transverse edge of the locking aperture remote from the fold line of the retaining tab and disposed within a securing aperture struck from the locking tab and disposed at the base thereof and adjacent the locking tab fold line so as positively to secure the panels together against relative movement.

7 Claims, 6 Drawing Figures

PANEL INTERLOCKING MEANS

One well known panel interlocking means for securing a pair of panels in overlapping face contacting relation is disclosed in expired U.S. Pat. No. 2,786,572 and comprises locking tabs struck from one panel which are arranged to be driven through corresponding locking apertures defined by retaining tabs struck from the other panel. The interlocking means of U.S. Pat. No. 2,786,572 forms a secure and reliable lock for use for example in article carriers of the wraparound type and secures the wrapper blank about a group of articles by operating against the tension of the blank so as to maintain package security. While some article carriers of the wraparound type which incorporate the panel interlocking means of U.S. Pat. No. 2,786,572 are adapted to function as containers for large primary packages, such carriers are not ordinarily especially adapted for use as returnable containers with the currently popular large primary containers. In certain instances large primary packages may be returned to the packager in view of the current emphasis on environmental considerations and for other reasons. The requirement for package integrity requires that panel interlocking means for use in conjunction with wraparound type carriers especially those for large bottles and cans must be secure even though tension of the wrapper blank may be substantial and even though the carrier locks may be weakened by excessive humidity.

According to this invention in one form, panel interlocking means of the type disclosed in U.S. Pat. No. 2,786,572 is improved so as substantially to enhance package security by the use of holding means such as a groove or the like formed in the shoulder portion of the locking tab for receiving the free end of the retaining tab when the locking tab is driven through the locking aperture defined by the retaining tab so as to hold the locking and retaining tabs in angular mutually braced relation to each other. In addition a securing tab arranged to project from an edge of the locking aperture is inserted into a securing aperture formed in the locking tab when the locking tab is driven through the locking aperture in conventional fashion.

For a better understanding of the invention reference may be had to the following detailed description taken in conjunction with the accompanying drawing in which FIG. 1 is a perspective view of a can wrapper shown in inverted position so as to expose the interlocking means which normally is formed in the bottom of the carrier;

FIG. 5 is a fragmentary cross sectional view taken along the line designated 5—5 in FIG. 2 and in which

Figure 3:
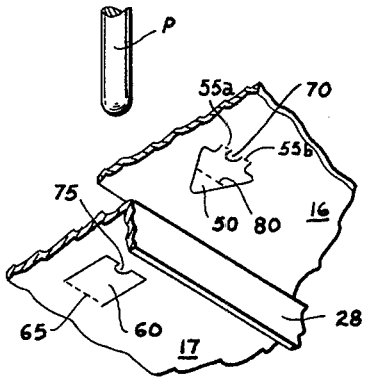
FIG. 3 is a perspective view of panels which are to be interlocked in overlapping relationship prior to engagement of the panels and prior to the initiation of an interlocking operation.

In the drawings the numeral 1 generally designates a main central panel in which a pair of finger gripping apertures 2 and 3 are formed. As explained, panel 1 normally constitutes the top panel of a carrier although in FIGS. 1, 3 and 4 the carton is shown in upside down position.

Side walls 4 and 5 are foldably joined to main panel 1 along interrupted fold lines 6 and 7 respectively and article receiving apertures 8, 9, 10 and 11 are formed along fold line 6 while similar apertures 12, 13, 14 and 15 are formed along fold line 7. The apertures 8–15 receive end portions of the packaged articles such as cans C in a manner well known in the art.

Lap panels 16 and 17 are foldably joined to the edges 18 and 19 of panels 4 and 5 respectively and article receiving apertures 20–23 are formed along fold line 18 while similar apertures 24–27 are formed along fold line 19 and are well known in the art.

For the purpose of separating the articles such as C1 in one row of articles from the articles such as C2 in the other row of articles, a medial keel panel 28 is foldably joined to lap panel 17 along fold line 29 and keel slits 30, 31 and 32 are formed along fold line 29 so as effectively to increase the width of lap panel 17 thereby to enhance locking security in a manner well known in the art.

In order to provide for tightening the blank about a group of articles prior to interlocking the panels 16 and 17, a plurality of tightening apertures 33–36 are formed in the lap panel 16 and similar tightening apertures 37–40 are formed in lap panel 17. As is well known machine elements enter tightening apertures 33–36 and move inwardly in opposition to the movement of corresponding machine elements which enter tightening apertures 37–40 and function in known manner to tighten the wrapper about the articles C. As is well known, cutaway areas 41–44 are formed along an edge of panel 16 so as to avoid interference with the machine tightening elements which enter tightening apertures 37–40 and similar cutaway areas 45–48 are formed in and edge of medial keel panel 28 so as to avoid interference with the machine elements which enter tightening apertures 33–36.

Figure 6:
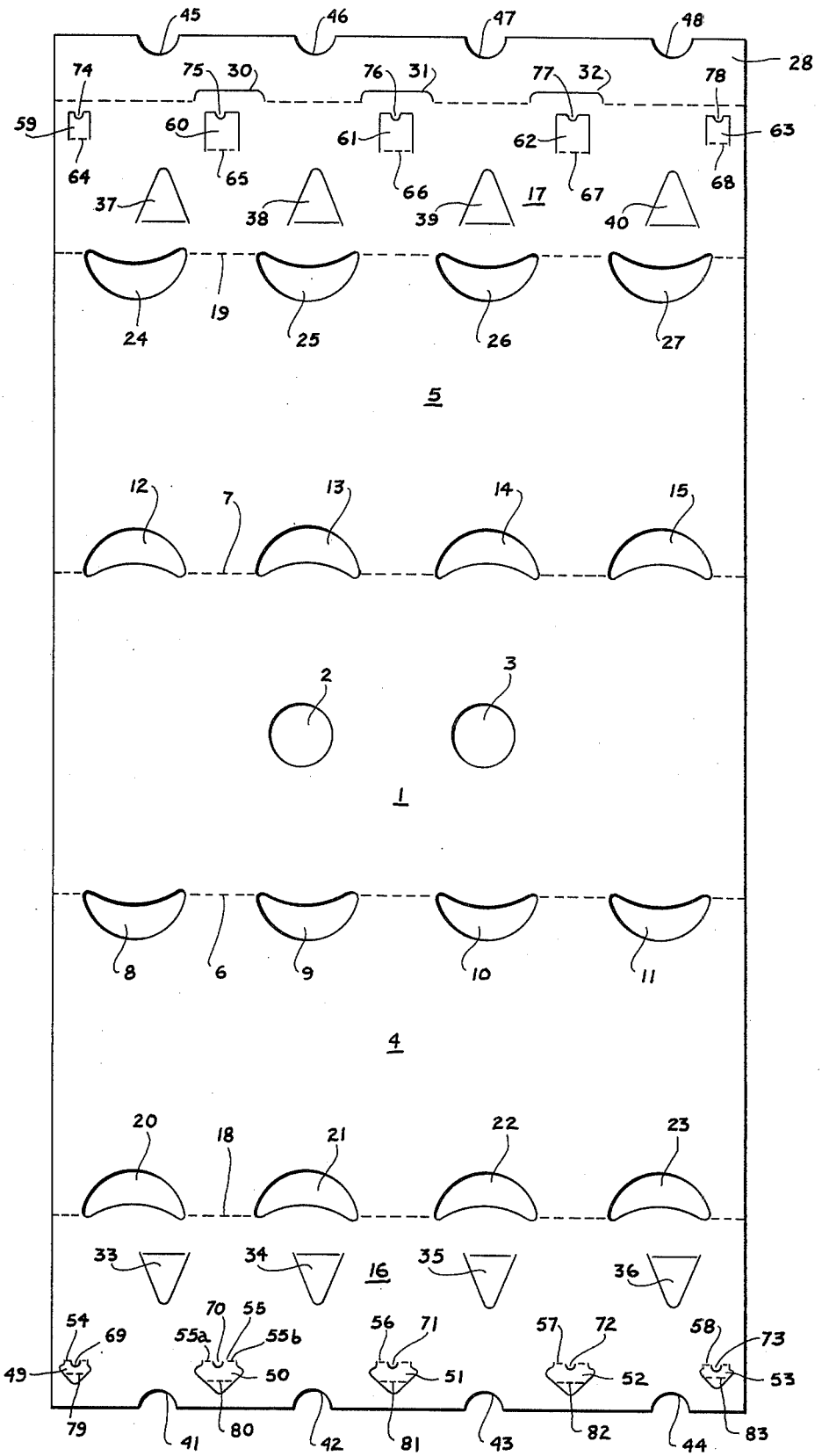
FIG. 6 is a plan view of a blank from which the carrier of FIG. 1 is formed.

For the purpose of securing lap panels 16 and 17 together in overlapping face contacting relation, a plurality of locking tabs 49–53 are struck from lap panel 16 and are foldably joined thereto along transverse fold lines 54–58 located at the base of the locking tabs 49–53 respectively. As shown in FIG. 6, these transverse fold lines are of an interrupted construction as indicated for example at **55*a* and 55*b***.

The locking tabs 49–53 cooperate with the locking apertures defined by retaining tabs 59–63 respectively which are struck from lap panel 17 and foldably joined thereto along end edge fold lines 64–68 respectively.

The structure as described above except for the interrupted fold lines such as **55*a* and 55*b*** is substantially in accordance with the prior art such as is represented by the aforementioned U.S. Pat. No. 2,786,572.

Securing apertures such as are designated by the numerals 69–73 are formed in the locking tabs 49–53 respectively and securing tabs 74–78 and form extensions of lap panel 17 which project from the transverse end edges of the locking apertures defined by retaining tabs 59–63 respectively while holding means in the form of grooves 79–83 are formed in locking tabs 49–53 respectively.

Figure 1:
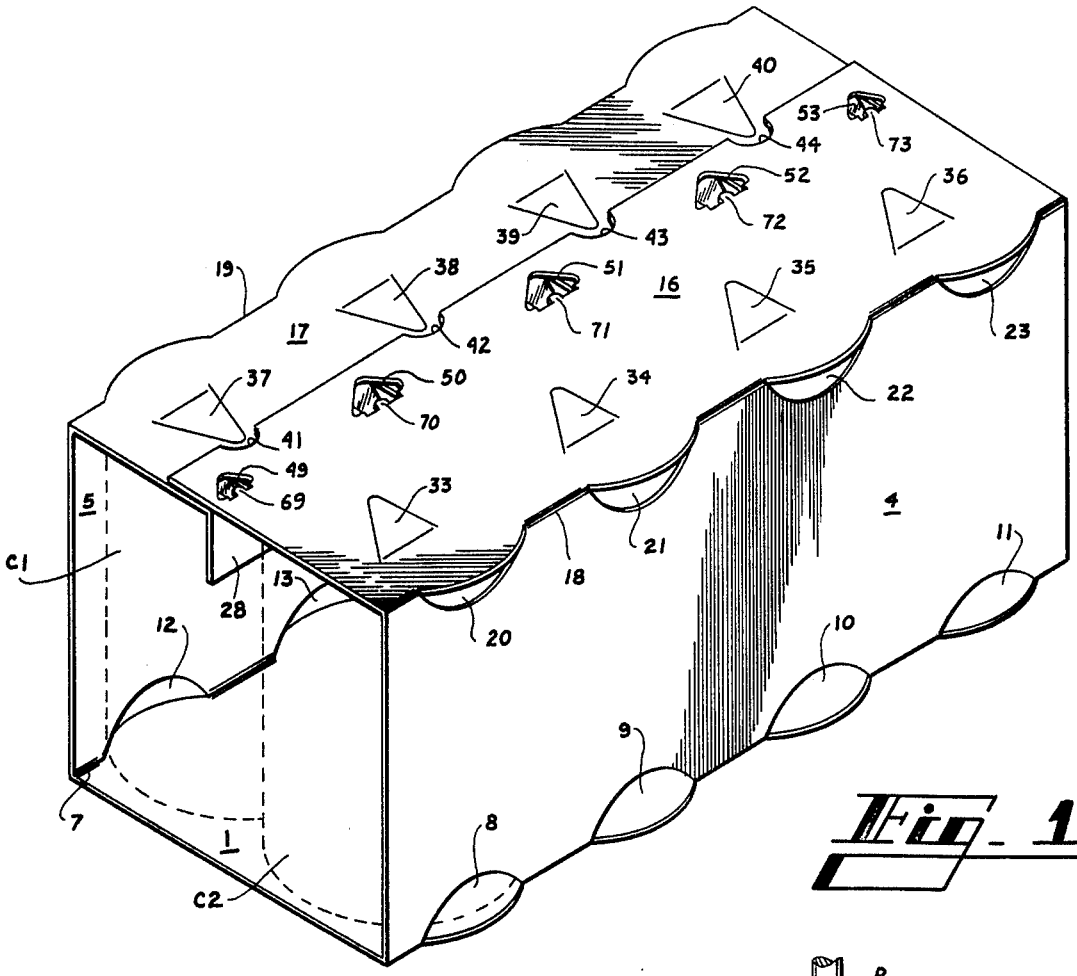
Figure 2:
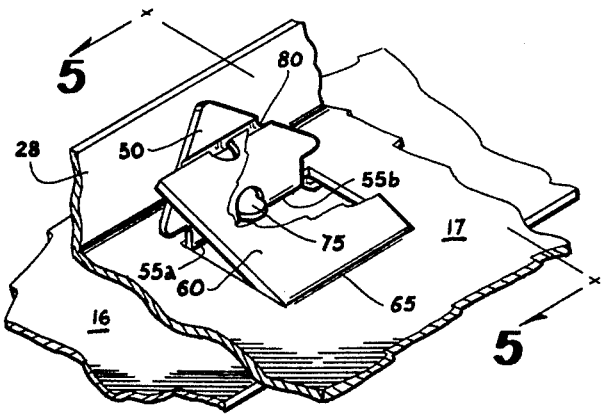
FIG. 2 is an enlarged perspective fragmentary view of one locking tab and its associated retaining tab together with holding means and a securing tab and securing aperture formed according to this invention and with the parts shown in locked condition and as viewed from a vantage point to the left of FIG. 1.
Figure 5:
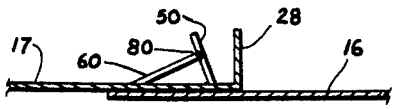
Figure 4:
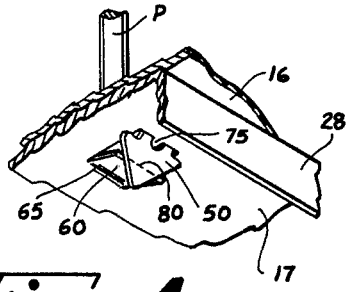
FIG. 4 is a view similar to FIG. 3 but which shows the panels in fully interlocked condition.

With the wrapper blank properly tightened about the group of articles C, the locking tabs 50–53 are engaged by locking plungers such as that schematically represented in FIGS. 1 and 4 at P and are driven through the locking apertures defined by retaining tabs 59–63 respectively. This action swings the retaining tabs 59–63 about their end edge fold lines 64–68 respectively and causes the free ends of the retaining tabs to engage the respective locking tabs to hold these tabs in angularly disposed braced relationship as is shown in FIGS. 2, 4 and 5. Engagement of the free ends of the retaining tabs 59–63 in the grooves 79–83 respectively aids in holding the locking and retaining tabs in angular mutually braced relation to each other. Instead of the grooves such as 79–83, suitable apertures could be provided or embossed or upraised ridges could be employed all within the meaning of the term "holding means".

Simultaneously with the performance of the locking operation by driving the locking tabs through the locking apertures, the securing tabs such as are designated by the numerals 74–78 inclusive are inserted into the securing apertures 69–73 respectively and serve to maintain the wrapper in locked condition. The securing tabs and their associated securing apertures serve to maintain lock security even though the fold lines such as 54–58 at the base of the locking tabs 49–53 respectively tend to "roll" or to shift position along their associated locking tabs. The tendency of the locking tab fold lines 54–58 to "roll" or to shift position from the base of the locking tab to a position somewhat removed from the base or from the normal disposition of the fold line sometimes is due to high humidity conditions which tend to weaken or to soften the material from which the wrapper is made such as paperboard.

While the securing apertures 69–73 preferably are disposed approximately midway between the ends of the interrupted fold lines 54–58, these apertures could be located at some other position along these fold lines and, if desired, more than one securing aperture such as 69–73 could be employed. Of course corresponding securing tabs such as 74–78 inclusive would be utilized so as to match the disposition of the apertures 69–73 respectively both as to position and number.

From the description above it is apparent that the securing tabs such as 74–78 or their equivalent in association with the securing apertures 69–73 or their equivalents serve to insure lock security even though ambient conditions are characterized by a high degree of humidity or in the event some other condition may occur which tends to shift the position of the fold lines such as 54–58 inclusive. In addition the securing tabs and apertures tend to enhance the bracing action of the retaining tabs by limiting relative movement between panels such as 16 and 17 and generally contribute to positive lock security. The holding means 79–83 serve to maintain the locks in locked condition particularly when wrapper tension is reduced as by removing one or more articles therefrom due to engagement of the free ends of the retaining tabs in the grooves 69–83 which action tends to prevent sliding of the retaining tabs along the locking tabs when wrapper tension is relaxed.

The embodiments of the invention in which an exclusive property or privilege is claimed are defined as follows:

1. An arrangement for interlocking a pair of panels in overlapping relation, said arrangement comprising a locking tab struck from one of said panels and joined thereto at its base and having generally parallel side edges and a shoulder portion at the end thereof remote from said base, said shoulder portion comprising tapered side edges, a retaining tab struck from the other of said panels and joined thereto at its base and defining a locking aperture in said other panel for receiving said locking tab and being oriented so that the base of said retaining tab is remote from the base of said locking tab, and a transverse holding groove formed in said shoulder portion of said locking tab and extending partially through said shoulder portion and to the tapered edges thereof, for receiving the free end of said retaining tab when said locking tab is driven through said locking aperture whereby said locking and retaining tabs are maintained in angular mutually braced relation to each other.

2. An arrangement for interlocking a pair of panels in overlapping relation, said arrangement comprising a locking tab struck from one of said panels and joined thereto at its base, a retaining tab struck from the other of said panels and joined thereto at its base and defining a locking aperture in said other panel for receiving said locking tab and being oriented so that the base of said retaining tab is remote from the base of said locking tab, a securing tab forming a projection of an edge of said locking aperture, a securing aperture formed in said locking tab for receiving said securing tab, and holding means formed in said locking tab for receiving the free end of said retaining tab when said locking tab is driven through said locking aperture whereby said locking and retaining tabs are maintained in angular mutually braced relation to each other.

3. An arrangement according to claim 2 wherein said securing aperture is disposed at the base of said locking tab.

4. An arrangement according to claim 2 wherein said locking tab is foldably joined at its base to said one panel along an interrupted fold line and wherein said securing aperture is disposed at an interrupted part of said interrupted fold line.

5. An arrangement for interlocking a pair of panels in overlapping relation, said arrangement comprising a locking tab struck from one of said panels and joined thereto at its base, a retaining tab struck from the other of said panels and joined thereto at its base and defining a locking aperture in said other panel for receiving said locking tab and being oriented so that the base of said retaining tab is remote from the base of said locking tab, said retaining tab and said locking aperture being of generally rectangular configuration, a securing tab struck from the free end of said retaining tab to form a projection of said other panel along an edge of said locking aperture remote from the base of said retaining tab, a securing aperture formed in said locking tab for receiving said securing tab when said locking tab is driven through said locking aperture, and holding means formed in said locking tab for receiving the free end of said retaining tab when said locking tab is driven through said locking aperture whereby said locking and retaining tabs are maintained in angular mutually braced relation to each other.

6. An arrangement according to claim 5 wherein said locking tab is joined to said one panel at its base along an interrupted fold line and wherein said securing aperture is disposed at an interrupted portion of said interrupted fold line.

7. An arrangement for interlocking a pair of panels in overlapping relation, said arrangement comprising a locking tab struck from one of said panels and foldably joined thereto along an interrupted fold line, a retaining tab struck from the other of said panels and foldably joined thereto along a fold line and defining a locking aperture in said other panel, a securing tab struck from said retaining tab and forming a projection of said other panel along a transverse edge of said locking aperture remote from said fold line, a securing aperture formed in said locking tab at an interrupted portion of said interrupted fold line for receiving said securing tab when said locking tab is driven through said locking aperture and with its interrupted fold line disposed adjacent said transverse edge of said locking aperture, and holding means formed in said locking tab for receiving the free end of said retaining tab remote from said fold line whereby said locking and retaining tabs are maintained in an angular mutually braced relation to each other.

* * * * *